US009388763B2

(12) United States Patent
Achenbach et al.

(10) Patent No.: US 9,388,763 B2
(45) Date of Patent: Jul. 12, 2016

(54) INTERNAL COMBUSTION ENGINE WITH LIGHT METAL ALLOY ENGINE BLOCK AND CAST IRON CYLINDER LINERS

(71) Applicant: DAIMLER AG, Stuttgart (DE)

(72) Inventors: Karl-Joerg Achenbach, Fellbach (DE); Eduard Prinz, Fellbach (DE)

(73) Assignee: DAIMLER AG, Stuttgart (DE)

( * ) Notice: Subject to any disclaimer, the term of this patent is extended or adjusted under 35 U.S.C. 154(b) by 38 days.

(21) Appl. No.: 13/844,994

(22) Filed: Mar. 17, 2013

(65) Prior Publication Data

US 2013/0213339 A1 Aug. 22, 2013

Related U.S. Application Data

(63) Continuation-in-part of application No. PCT/EP2011/004637, filed on Sep. 15, 2011.

(30) Foreign Application Priority Data

Oct. 1, 2010 (DE) ..... 10 2010 047 325

(51) Int. Cl.

| | |
|---|---|
| ***F01P 3/02*** | (2006.01) |
| ***F02F 7/00*** | (2006.01) |
| ***F02F 1/00*** | (2006.01) |
| ***F02F 1/10*** | (2006.01) |
| ***F02F 1/14*** | (2006.01) |

(52) U.S. Cl.

CPC . *F02F 7/00* (2013.01); *F02F 1/004* (2013.01); *F02F 1/102* (2013.01); *F02F 1/14* (2013.01); *Y10T 29/49231* (2015.01)

(58) Field of Classification Search

CPC . F01P 3/02; F01P 2003/021; F01P 2003/028; F02F 1/36–1/40

USPC ..... 123/193.1, 41.82 R, 41.79

See application file for complete search history.

(56) References Cited

U.S. PATENT DOCUMENTS

| | | | | | |
|---|---|---|---|---|---|
| 4,616,603 | A * | 10/1986 | Kubis | F02B 75/16 | 123/193.2 |
| 5,217,059 | A * | 6/1993 | Kuhn et al. | 164/132 | |
| 5,333,668 | A * | 8/1994 | Jorstad | B22D 19/0009 | 164/100 |
| 5,676,096 | A | 10/1997 | Nishi et al. | | |
| 6,123,052 | A | 9/2000 | Jahn | | |
| 6,349,681 | B1 * | 2/2002 | Li | 123/41.74 | |
| 2005/0173091 | A1 * | 8/2005 | Cantu-Gonzalez et al. | 164/98 | |
| 2005/0217615 | A1 * | 10/2005 | Matsutani et al. | 123/41.74 | |

(Continued)

FOREIGN PATENT DOCUMENTS

| | | | | |
|---|---|---|---|---|
| DE | 41 17 112 | | 6/1992 | |
| DE | 10 2007 041 010 | | 3/2009 | |
| DE | WO 2009026898 | A1 * | 3/2009 | B22D 19/0009 |
| JP | 10 299 566 | A | 11/1998 | |
| JP | 2004 0484622 | A | 3/2004 | |

(Continued)

*Primary Examiner* — Lindsay Low
*Assistant Examiner* — Kevin Lathers
(74) *Attorney, Agent, or Firm* — Klaus J. Bach

(57) ABSTRACT

In an internal combustion engine for a motor vehicle, having a cylinder housing in the form of a light metal alloy casting with working cylinder sections including cylinder liners which consist of rough-surface iron castings and which are integrally cast into the working cylinder sections with housing webs formed between adjacent liners, the cylinder housing has cooling channels formed in the housing webs between adjacent cylinder liners and the working cylinder sections of the cylinder housing for directly cooling the cylinder liners.

5 Claims, 2 Drawing Sheets

(56) References Cited

U.S. PATENT DOCUMENTS

| | | | | |
|---|---|---|---|---|
| 2006/0124082 | A1* | 6/2006 | Grunenberg et al. | 123/41.74 |
| 2011/0030627 | A1* | 2/2011 | Bing | B22D 19/0009 123/41.79 |

FOREIGN PATENT DOCUMENTS

| | | | |
|---|---|---|---|
| JP | 2009 013836 | A | 1/2009 |
| JP | WO 2009/026898 | A | 3/2009 |

* cited by examiner

INTERNAL COMBUSTION ENGINE WITH LIGHT METAL ALLOY ENGINE BLOCK AND CAST IRON CYLINDER LINERS

This is a Continuation-In-Part application of pending international patent application PCT/EP2011/004637 filed Sep. 15, 2011 and claiming the priority of German patent application 10 2010 047 325.1 filed Oct. 1, 2010.

BACKGROUND OF THE INVENTION

The invention relates to an internal combustion engine comprising an injection-molded light metal alloy engine block and cast iron cylinder liners molded into the engine block or housing.

An internal combustion engine for a motor vehicle having an engine block with at least one working cylinder is already known from DE 41 17 112 C1.

It is the principal object of the present invention to provide a cost-effective internal combustion engine with cylinder liners molded into the engine block and with an advantageous cooling arrangement.

SUMMARY OF THE INVENTION

In an internal combustion engine for a motor vehicle, having an engine block consisting of an injection molded light metal alloy with at least two working cylinders separated by a housing web, each working cylinder including a cylinder liner which consists of cast iron and which is molded integrally into the engine block has cylinder housings with webs disposed between adjacent cylinder and at least one cooling channel, which extends through the housing web between adjacent cylinder liners so as to be delimited directly by the liner walls.

With the use of cost-effective cast iron cylinder liners, cooling, in particular water cooling of the cylinder liners, can be improved. By using the cost-effective cylinder liners, costs for the combustion engine can be reduced. It is advantageous for a cooling means in the cooling channel to have direct contact with a part of the cylinder liner, at least temporarily. The cooling means is preferably water. The cooling channel is preferably produced by machining it into the web of the cylinder housing and, partially, the cylinder liner. It is preferable for the cylinder housing and the cylinder liner to be machined together. To produce the cooling channel, excess material is preferably machined out of the cylinder housing and the cylinder liner.

It is further proposed that the internal combustion engine has at least one form-fit region, in which the cylinder liner and the cylinder housing are connected to one another and in which the cooling channel is at least partially arranged. Thus, particularly advantageous cooling of the cylinder liner can be achieved. "Form fit region" is in particular to be understood as a region in which a material of the cylinder and a material of the cylinder liner at least partially overlap, and the cylinder housing and the cylinder liner are interlocked.

In an advantageous embodiment, the internal combustion engine has at least a second cylinder liner, disposed next to the first cylinder liner with the cooling channel extending therebetween. Thus, cooling of two cylinder liners can be provided for by each cooling channel.

It is further proposed that the cylinder housing have at least one web between two adjacent cylinder liners and that the cooling channel extends at least partially through the web between cylinders. Thus, particularly advantageous cooling of the cylinder housing and the cylinder liner can be achieved.

The web between cylinders may be a small wall between two adjacent working cylinder liners. It is preferable for the wall between cylinders to be part of the cylinder housing.

It is particularly advantageous if the cooling channel is at least partially in the form of a material recess, which is at least partially formed into the cylinder housing and the cylinder liner. Thus the cooling channel can be formed in a particularly simple manner.

It is furthermore advantageous if the cooling channel is formed after installation of the liners, that is after the cylinder liner has been integrally cast into the cylinder housing. Thus, a particularly advantageous cooling channel can be provided.

It is particularly preferable for the cooling channel to be in the form of a bore-hole. Establishing the cooling channel can thus be simplified.

Moreover, it is proposed that the cylinder housing is at least partially of a light injection molded metal alloy. Thus, a particularly advantageous cylinder housing can be formed.

The invention will become more readily apparent from the following description of an exemplary embodiment of the invention with reference to the accompanying drawings. An exemplary embodiment of the invention is depicted in the figures. The figures, the description and the claims contain numerous features in combination. The person skilled in the art will also consider the features individually and may integrate them into further worthwhile combinations.

DESCRIPTION OF AN EXEMPLARY EMBODIMENT

Figure 1:
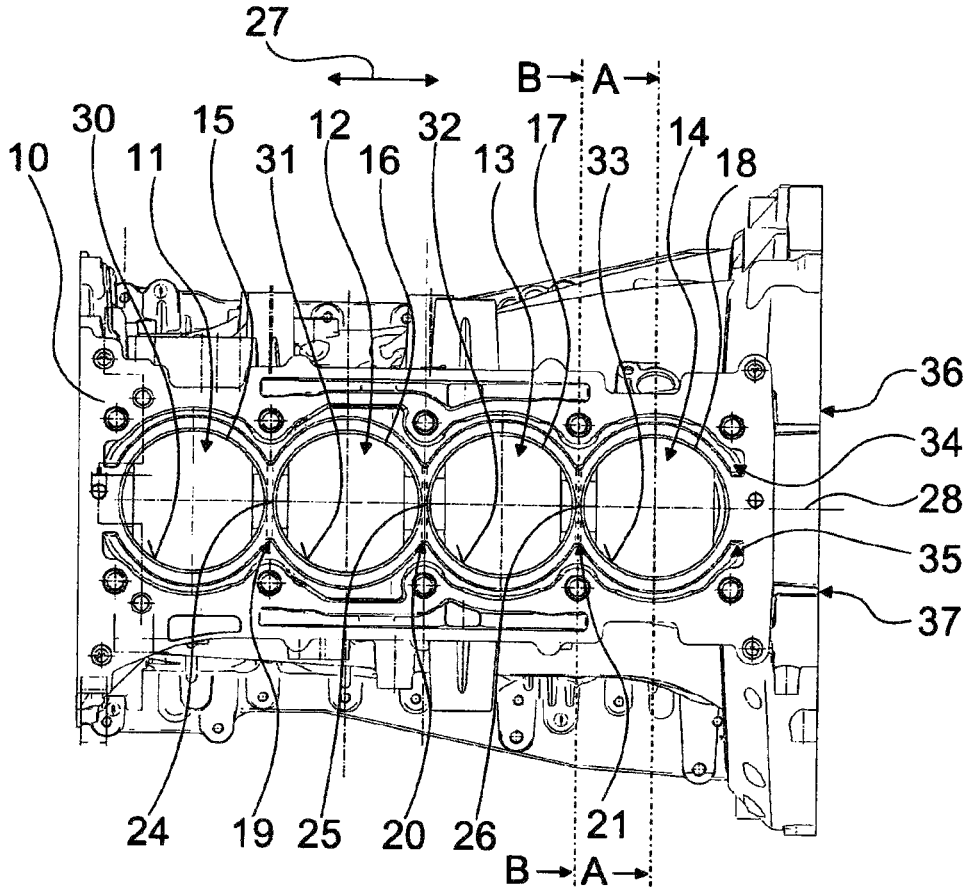
FIG. 1 is a top view of a cylinder housing with integrally cast cylinder liners.
Figure 2:
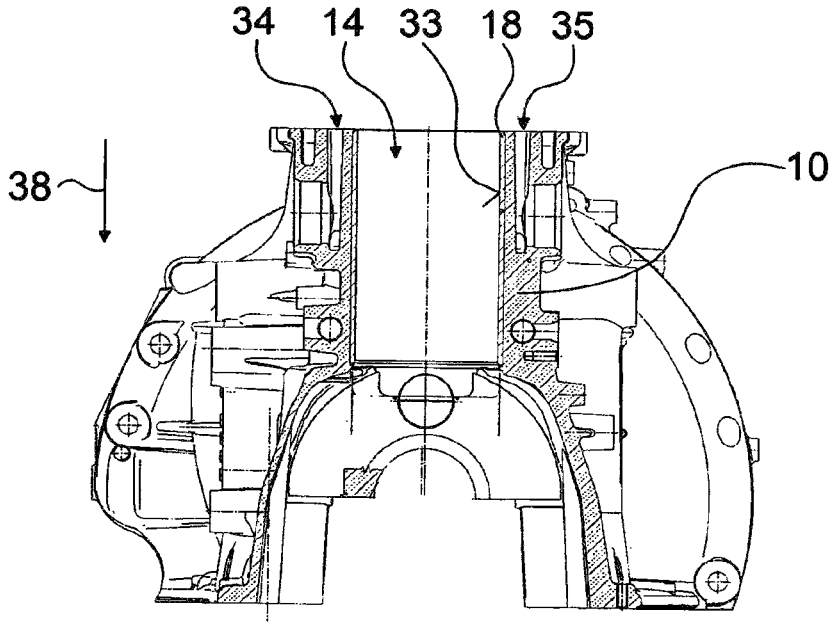
FIG. 2 shows the cylinder housing in a cross-section through one of the cylinder liners taken along the line A-A of FIG. 1.
Figure 3:
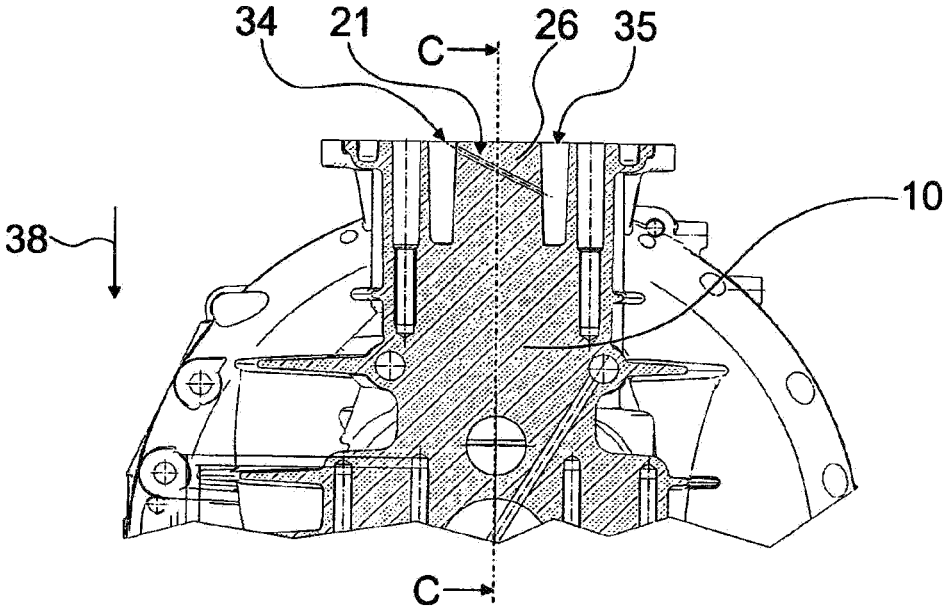
FIG. 3 shows the cylinder housing in a cross-section through a wall between cylinders along the line B-B of FIG. 1.

FIGS. 1 to 4 show, in part, an internal combustion engine block for a motor vehicle. The internal combustion engine block is part of a motor vehicle internal combustion engine that is generally a multi-cylinder internal combustion engine.

An internal combustion engine includes and an engine short block with a crankcase top section and a cylinder housing 10 forming the working cylinders 11, 12, 13, 14. The cylinder housing 10 is produced by a casting method. The cylinder housing 10 is generally a light metal alloy body formed by injection molding or die casting. It consists of aluminum or an alloy containing aluminum.

To receive the cylinder liners 15, 16, 17, 18, the cylinder housing 10 has four working cylinder sections 11, 12, 13, 14. The four working cylinder sections 11, 12, 13, 14 are arranged in a line. The cylinder line extends in a direction 27 which is parallel to a longitudinal axis 28 of the cylinder housing 10. The cylinder line extends along the longitudinal axis 28. The working cylinder sections 11, 12, 13, 14 are arranged alongside each other. They are adjacent to one another. The working cylinder sections 11, 14 are arranged at the end and the working cylinder sections 12, 13 in the center of the line. The working cylinder sections 11, 12, 13, 14 are designed analogously to one another.

Figure 4:
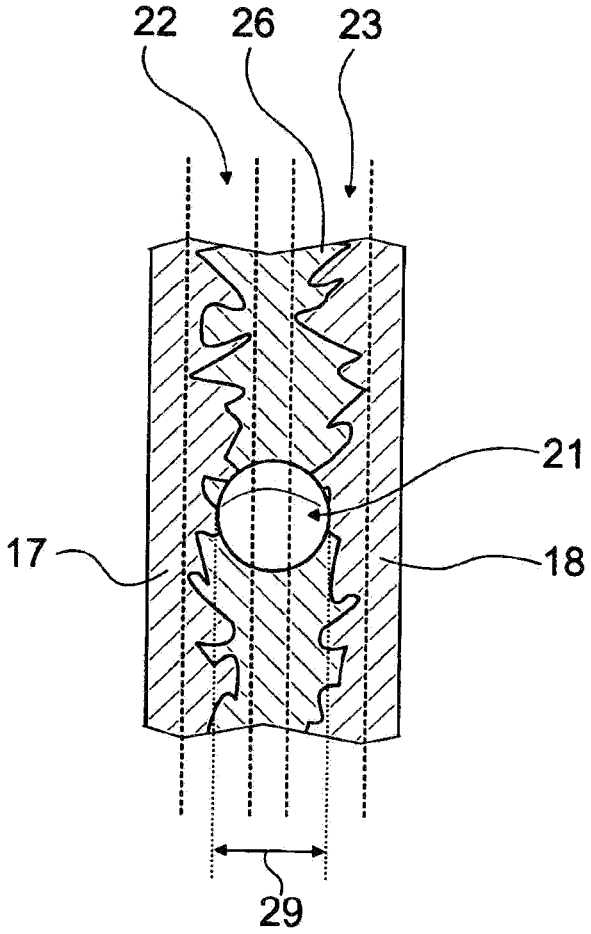
FIG. 4 shows schematically a cross-section of a wall area between adjacent liners taken along line C-C and showing a cooling channel.

The cylinder housing 10 also has three webs 24, 25, 26 extending between the cylinder sections. The webs each separate two adjacent working cylinder sections 11, 12, 13, 14. The working cylinders 11, 12 are separated by the web 24, the working cylinders 12, 13 by the web 25 and the working cylinders 13, 14 by the web 26. The web 24 is arranged between the working cylinders 11, 12. The web 25 is arranged between the working cylinders 12, 13. The web 26 is arranged between the working cylinders 13, 14. The webs 24, 25, 26 are thin walls, each having only a minimal thickness 29 in the direction 27, that is, in the direction of the longitudinal axis 28. The minimal thickness 29 of the web 26 is depicted in FIG. 4.

To form four piston bearing surfaces 30, 31, 32, 33, the cylinder housing 10 of the shown four-cylinder internal combustion engine includes four cylinder liners 15, 16, 17, 18. The cylinder liners 15 forms the cylinder bearing surface 30, the cylinder liner 16 forms the cylinder bearing surface 31, the cylinder liner 17 forms the cylinder bearing surface 32 and the cylinder liner 18 forms the cylinder bearing surface 33.

Each cylinder liner 15, 16, 17, 18 is integrally cast or molded into each working cylinder section 11, 12, 13, 14. The cylinder liner 15 is integrally cast into the working cylinder section 11, the cylinder liner 16 into the working cylinder section 12, the cylinder liner 17 into the working cylinder section 13 and the cylinder liner 18 into the working cylinder section 14. The external surfaces of the individual, integrally cast cylinder liners 15, 16, 17, 18 thus rests on an internal surface of the corresponding working cylinder sections 11, 12, 13, 14. The internal surfaces of the individual cylinder liners 15, 16, 17, 18 form the respective piston bearing surfaces 30, 31, 32, 33. The cylinder liners 15, 16, 17, 18 are so-called dry cylinder liners. The external surfaces of the individual cylinder liners 15, 16, 17, 18 are formed by rough-surface casting. The cylinder liners 15, 16, 17, 18 are designed analogously to one another. The cylinder housing 10 and the cylinder liners 15, 16, 17, 18 that are cast integrally into the working cylinder sections 11, 12, 13, 14 form a heterogeneous engine block.

Adjacent cylinder liners 15, 16, 17, 18 are connected to one another by one of the webs 24, 25, 26. The adjacent cylinder liners 15, 16 are joined by the web 24. The adjacent cylinder liners 16, 17 are joined by the web 25. The adjacent cylinder liners 17, 18 are joined by the web 26.

The internal combustion engine also has four form fit regions, wherein only one form fit region 22 and one form fit region 23 are depicted in FIG. 4. In the non-depicted form fit regions and in the form fit regions 22, 23, the respective cylinder liners 15, 16, 17, 18 are connected to the respective working cylinder sections 11, 12, 13, 14. The form fit regions 22, 23 and the non-depicted form fit regions are designed analogously. Thus, only the form fit region 22 and the form fit region 23 are illustrated in greater detail below.

A material of the cylinder liner 17 partially engages a material of the cylinder housing 10 in the form fit region 22. In the form fit region 22, the cylinder liner 17 and the cylinder housing 10 interlock in the working cylinder section 13. The internal surface of the working cylinder section 13 and the external surface of the cylinder liner 17 are form fittingly interconnected together. The internal surface of the working cylinder section 13 and the external surface of the cylinder liner 17 are arranged within the form fit region 22. A connection between the cylinder liner 17 and the cylinder housing 10 takes places in the form fit region 22 in the working cylinder section 13. The form fit region 22 extends along a periphery of the working cylinder section 13 and the cylinder liner 17. The integrally cast cylinder liner 17 and the working cylinder section 13 have a form fit in the form fit region 22 that is they are interlocked.

In the same way, a material of the cylinder liner 18 partially engages the material of the cylinder housing 10 in the form fit region 23. In the form fit region 23, the cylinder liner 18 and the cylinder housing 10 interlock with the working cylinder section 14. The internal surface of the working cylinder section 14 and the external surface of the cylinder liner 18 are form-fittingly joined. The internal surface of the working cylinder section 14 and the external surface of the cylinder liner 18 are arranged within the form fit region 23. There is a firm connection between the cylinder liner 18 and the cylinder housing 10 in the form fit region 23 in the working cylinder 14. The form fit region 23 extends along a periphery of the working cylinder section 14 and the cylinder liner 18. The integrally cast cylinder liner 18 and the working cylinder section 14 have a form fit in the form fit region 23.

To cool the working cylinder sections 11, 12, 13, 14 and thus the cylinder liners 15, 16, 17, 18, the cylinder housing 10 has a cooling jacket 34 and a cooling jacket 35. The cooling jackets 34, 35 are arranged opposite each other in spaced relationship. The cooling jacket 34 extends on one side 36 along the cylinder row formed by the working cylinder sections 11, 12, 13, 14. On the side 36, the cooling jacket 34 encloses all working cylinder sections 11, 12, 13, 14 and thus all cylinder liners 15, 16, 17, 18. The cooling jacket 35 extends on an opposite side 37 along the cylinder row formed by the working cylinder sections 11, 12, 13, 14. On the opposite side 37, the cooling jacket 35 encloses all working cylinder sections 11, 12, 13, 14 and thus all cylinder liners 15, 16, 17, 18. The cooling jacket 34 and the cooling jacket 35 extend along the longitudinal axis 28 of the cylinder housing 10.

To cool the walls between cylinders 24, 25, 26, the cylinder housing 10 has three cooling channels 19, 20, 21. The cooling channel 19 is provided to cool the web 24 and is arranged in the web 24. The cooling channel 20 is provided to cool the web 25 and is arranged in the web 25. The cooling channel 21 is provided to cool the web 26 and is arranged in the web 26. The cooling channels 19, 20, 21 are consequently each arranged between two adjacent working cylinder sections 11, 12, 13, 14 and thus between two adjacent cylinder liners 15, 16, 17, 18. The cooling channels 19, 20, 21 each border on two adjacent cylinder liners 15, 16, 17, 18. The cooling channel 19 borders partially on the cylinder liners 15, 16. The cooling channel 20 borders partially on the cylinder liners 16, 17. The cooling channel 21 borders partially on the cylinder liners 17, 18. The cooling channels 19, 20, 21 are designed analogously to rune another. Thus, only the cooling channel 21 is described in greater detail below.

The cooling channel 21 extends through the web 26. The cooling channel 21 extends through the web 26 perpendicularly to the direction 27 of the longitudinal extension of the cylinder row. The cooling channel 21 penetrates the web 26 perpendicularly to the longitudinal axis 28 of the cylinder housing 10. The cooling channel 21 connects the two cooling jackets 34, 35 to one another fluidically. The cooling channel 21 connects the cooling jackets 34, 35 at different levels. In the direction 38, the cooling channel 21 is arranged in a low-lying region of the cooling jacket 35 and extends to an upper region of the cooling jacket 34. The cooling channel 21 connects two regions of different levels of the cooling jackets 34, 35. The direction 38 is thus arranged perpendicularly to the longitudinal axis 28 and tilted toward a crankshaft that is not depicted here. The cooling channel 21 is extends angularly inclined.

As shown in FIG. 4, the cooling channel 21 is arranged partially in the form fit region 22 and partially in the form fit region 23. The cooling channel 21 thus extends partially in the two form fit regions 22, 23. The cooling channel 21 partially extends through the form fit regions 22, 23. The cooling channel 21 thus reduces the size of the form fit region 22 and the form fit region 23. The center point of the cooling channel 21 is arranged between the form fit regions 22, 23. The cylinder liner 17 and the cylinder liner 18 border the cooling channel 21 on two opposing sides. The cooling channel 21 extends through the wall between cylinders 26 so that the cylinder liner 17 and the cylinder liner 18 are exposed to coolant in the coaling channel 21. The cooling channel 21 has a diameter that corresponds to the minimal extension 29 of the web between cylinders 26.

The cooling channel 21 is in the form of a material recess. The material recess is formed into the web 26 of the cylinder housing 10 and partially into the cylinder liners 17, 18. The cooling channel 21 is produced by removing the material of the web 26, and partially even of the cylinder liners 17, 18 that are engaging the web 26.

The cooling channel 21 is in the form of a bore-hole. The cooling channel 21 may be particularly as an additionally formed cooling channel. This means that the cooling channel 21 is formed after the cylinder liners 17, 18 have been integrally cast into the working cylinder section 14. The cooling channel 21 is preferably cut into the wall between cylinders 26 when the cylinder liners 17, 18 have been integrally cast. It is fundamentally also conceivable for several cooling channels to extend through one web between two cylinders.

What is claimed is:

1. An internal combustion engine for a motor vehicle having a cylinder housing (10) in the form of a light metal casting with at least two working cylinder sections (11, 12, 13, 14), including separate individual cylinder liners (15, 16, 17, 18) which consist of cast iron of rough-surface iron casting and which are integrally cast into the working cylinder sections (11, 12, 13, 14) with cylinder housing webs (24, 25, 26) with form-fit regions (22, 23) formed between adjacent cylinder liners (15, 16, 17, 18), the cylinder housing (10) including bore holes (19, 20, 21) formed in the cylinder housing webs (24, 25, 26) between the cylinder liners (15, 16, 17, 18) so as to extend through the form-fit regions (22, 23) in which the cylinder liners (15, 16, 17, 18) and the cylinder housing (10) are connected to one another and forming channels (19, 20, 21) for cooling the cylinder liners (15, 16, 17, 18), the bore holes (19, 20, 21), which have been formed by material removal after the liners have been cast into the working cylinder sections (11, 12, 13, 14) having a width at least as large as the width of the form-fit regions (22, 23) between adjacent cylinder liners (15, 16, 17, 18) so as to extend into the adjacent cylinder liners whereby the cooling channels (19, 20, 21) are partially delimited directly by the cylinder liners (15, 16, 17, 18) and the cylinder liners (15, 16, 17, 18) cast into the cylinder housing of the light metal casting are directly exposed to coolant in the cooling channels (19, 20, 21).

2. The internal combustion engine according to claim 1, wherein the bore holes forming the cooling channel (19, 20, 21) have a width so as to extend partially into both of the adjacent cylinder liner (15, 16, 17, 18).

3. The internal combustion engine according to claim 1, wherein the cylinder housing (10) consists at least partially of a light-weight injection-molded metal alloy.

4. The internal combustion engine according to claim 1, wherein the bore holes forming the cooling channels (19, 20, 21) extend through the cylinder housing webs (24, 25, 26) in a tilted fashion so that each cooling channel extends angularly inclined from one level at one side of the cylinder housing (10) to a higher level at the opposite side of the cylinder housing (10).

5. A method for producing a combustion engine having a cylinder housing (10) consisting of a light metal alloy with at least two cylinder liners (15, 16, 17, 18) with a rough outer surface casting being molded into the cylinder housing (10) so as to be separated by a housing web (24, 25, 26), said method comprising the step of:

drilling at least one cooling channel (19, 20, 21) through the housing webs (24, 25, 26 between adjacent cylinder liners to form between adjacent cylinder liners a passage of a diameter corresponding at least to the width of the housing webs (24, 25, 26) between the cylinder liners (15, 16, 17, 18) so that the at least one cooling channel is delimited at least partially directly by the cylinder liners for directly cooling the cylinder liners.

* * * * *